US008867980B2

(12) United States Patent
Inoue

(10) Patent No.: US 8,867,980 B2
(45) Date of Patent: Oct. 21, 2014

(54) IMAGE FORMING APPARATUS

(75) Inventor: Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 919 days.

(21) Appl. No.: 12/689,526

(22) Filed: Jan. 19, 2010

(65) Prior Publication Data

US 2010/0189486 A1 Jul. 29, 2010

(30) Foreign Application Priority Data

Jan. 29, 2009 (JP) ..... 2009-018815

(51) Int. Cl.
*G03G 15/00* (2006.01)

(52) U.S. Cl.
CPC .... *G03G 15/657* (2013.01); *G03G 2215/00721* (2013.01); *G03G 2215/00413* (2013.01); *G03G 2215/00561* (2013.01); *G03G 2215/00565* (2013.01); *G03G 2215/00586* (2013.01); *G03G 2215/0043* (2013.01)
USPC ..... 399/381; 399/388; 399/394; 399/395

(58) Field of Classification Search
CPC ..... G03G 2215/00586; G03G 2215/00721; G03G 2215/00565; G03G 2215/00561; B65H 2301/3611
USPC ..... 399/395, 394, 381, 388, 400
See application file for complete search history.

(56) References Cited

U.S. PATENT DOCUMENTS

| | | | | |
|---|---|---|---|---|
| 4,799,084 | A | 1/1989 | Koike et al. | 355/14 SH |
| 5,055,756 | A | 10/1991 | Ohkoda et al. | |
| 5,358,230 | A | 10/1994 | Ikemori et al. | |
| 5,485,991 | A | 1/1996 | Hirano et al. | |
| 5,867,196 | A | 2/1999 | Kiyohara et al. | |
| 5,899,451 | A | 5/1999 | Kiyohara et al. | |
| 5,992,993 | A | 11/1999 | Kiyohara et al. | |
| 6,131,899 | A | 10/2000 | Nojima et al. | |
| 6,200,043 | B1 | 3/2001 | Inoue et al. | |
| 6,356,735 | B1 * | 3/2002 | Hozumi | 399/395 |
| 2003/0129008 | A1 * | 7/2003 | Seto | 399/388 |
| 2007/0292180 | A1 | 12/2007 | Suzuki et al. | |

FOREIGN PATENT DOCUMENTS

JP 2001-39546 2/2001

* cited by examiner

*Primary Examiner* — Judy Nguyen
*Assistant Examiner* — Jennifer Simmons
(74) *Attorney, Agent, or Firm* — Fitzpatrick, Cella, Harper & Scinto

(57) ABSTRACT

An image forming apparatus has a pair of registration rollers which are moved in the width direction so that a sheet side end position is within a predetermined range in the width direction based on sheet side end position information from a lateral registration detection sensor. In the case that an image-formed sheet is conveyed to a sheet processing portion without being reversed, the pair of registration rollers are moved so that the sheet side end position is within the first range, and in the case that an image-formed sheet is conveyed to the sheet processing portion, the pair of registration rollers are moved so that the sheet side end position is within the second range being different from the first range before reversing and within the first range after reversing.

7 Claims, 13 Drawing Sheets

Reciprocation position
Reciprocation ΔLx
Nx
N0
N'x
Roller life time

Reciprocation position
Ny
N0
N'y
Reciprocation ΔLy
Roller life time

Prolonged life time Δ2
Reciprocation position
Ny
Nx
N0
N'x
N'y
Roller life time

IMAGE FORMING APPARATUS

BACKGROUND OF THE INVENTION

1. Field of the Invention

The present invention relates to an image forming apparatus, in particular, relates to a configuration to correct a side end position of a sheet.

2. Description of Related Art

In the related art, there has been an image forming apparatus such as a copying machine, a printer and a facsimile machine provided with a sheet processing portion to perform a process such as stapling, aligning and binding against image-formed sheets while a sheet cassette as a sheet accommodation portion is detachably attached to an image forming apparatus main body. When forming an image, a sheet accommodated in the sheet cassette is fed by a sheet feeding roller and conveyed to an image forming portion. Then, the image-formed sheet is conveyed to a fixing portion and the image is fixed on the sheet. Subsequently, the image-fixed sheet is conveyed to the sheet processing portion and the process such as binding is performed.

Here, there has been an image forming apparatus provided with a skew-feeding correction portion to perform correction of sheet skew feeding and sheet displacement in the direction perpendicular to the sheet conveying direction (hereinafter, called the width direction) in order to adjust the posture and position of a sheet. As such a skew-feeding correction portion, a configuration to perform correction of a displacement of sheet in the width direction by a pair of slidable registration rollers has been disclosed in U.S. Pat. No. 4,799,084.

FIG. 10 is a view which illustrates the configuration of a registration device arranged at an image forming apparatus capable of performing multiple transferring having a pair of slidable registration rollers. When performing multiple transferring onto a sheet, the registration device performs correction of the displacement in the width direction by utilizing the pair of slidable registration rollers 40 so that color shifting between the first color and the second color is accurately corrected.

In the registration device, when a sheet is conveyed, skew feeding of the sheet top end is corrected by firstly hitting the sheet top end to the pair of registration rollers 40 slidable in the axis direction and forming a loop with a conveying roller 36 at the upstream side. Next, the sheet of which skew feeding is corrected is moved to slide in the axis direction while being conveyed by the pair of registration rollers 40, and then, the side end of the slide-moved sheet is detected by an optical sensor 61. Then, the image of the first color is formed on the sheet moved to the position where the side end is detected by the optical sensor 61.

Next, when forming the image of the second color, the sheet is conveyed to the pair of registration rollers 40 again and skew feeding is corrected after the image of the first color is formed. Subsequently, the sheet of which skew feeding is corrected is moved to slide while being conveyed by the pair of registration rollers 40, and then, the side end of the slide-moved sheet is detected by the optical sensor 61. Accordingly, even in the case of forming the second color image, the displacement of sheet in the width direction can be accurately corrected and the sheet can be moved to the same position as that for forming the first color image.

Meanwhile, in recent years, a various sheet types such as coated paper, embossed paper, extremely thick paper and extremely thin paper are becoming popular to be used for image forming apparatuses. Accordingly, in addition to high productivity, skew-feeding correction at high speed and high accuracy has been desired for image forming apparatuses in order to be capable of supporting every type of sheets for using.

In order to achieve skew-feeding correction at high speed and high accuracy, a skew-feeding correction portion of an active skew-feeding correction type to correct skew feeding while conveying a sheet without stopping once has been proposed in Japanese Patent Application Laid-Open 2001-39546.

FIG. 11 is a view which illustrates the configuration of the skew-feeding correction portion of the active skew-feeding correction type in the related art. Pairs of skew-feeding correction rollers 21, 22 are illustrated in FIG. 11. The pairs of skew-feeding correction rollers 21, 22 respectively include a skew-feeding correction drive roller 21*a*, 22*a* shaped respectively to have a cutout portion at a part of the circumference thereof. A pair of registration rollers 30 are movable in the width direction and include a registration drive roller 30*a* shaped to have a cutout portion at part of the circumference thereof.

Activation sensors 27*a*, 27*b* to detect sheet skew feeding are arranged respectively at the upstream side in the sheet conveying direction of the pairs of skew-feeding correction rollers 21, 22. Skew-feeding detection sensors 28*a*, 28*b* are arranged respectively at the downstream side in the sheet conveying direction of the pairs of skew-feeding correction rollers 21, 22. Further, a registration sensor 131 to detect a sheet top end is arranged at the downstream side in the sheet conveying direction of the pair of the registration rollers 30. A lateral registration sensor 35 detects a sheet side end position in the width direction. Further, a registration HP sensor 32 and a registration shift HP sensor 34 are provided. Skew-feeding correction HP sensors 25, 26 respectively detect the home position (HP) of the pairs of skew-feeding correction rollers 21, 22.

With the skew-feeding correction portion as configured as described above, when the activation sensors 27*a*, 27*b* and the skew-feeding detection sensors 28*a*, 28*b* detect a sheet top end, driving of the skew-feeding correction motors 23, 24 is started in accordance with the detection timing. Accordingly, as illustrated in FIG. 12A, the pairs of skew-feeding correction rollers 21, 22 are rotated, so that skew-feeding correction of a sheet S is performed while conveying the sheet S. Next, as illustrated in FIG. 12B, the skew-feeding correction drive rollers 21*a*, 22*a* are positioned as the cutout portion facing to the sheet S. Then, the correction of the top end registration and side end registration is performed by the pair of registration rollers 30 in the state that nipping of the sheet S by the pairs of skew-feeding correction rollers 21, 22 is released.

That is, when the top end of the sheet S is detected by the registration sensor 131, a registration motor 31 is driven so as to align the image position on the photosensitive drum (not illustrated) and the top end position of the sheet S and controls rotation of the pair of registration rollers 30. Further, a lateral registration motor 33 is driven based on the detection signal from the lateral registration sensor 35 and the pair of registration rollers 30 are laterally moved so as to align the image position on the photosensitive drum and the position in the width direction of the sheet S. In this manner, the position of the sheet S can be accurately corrected against the image on the photosensitive drum and sheet conveying can be repeatedly performed thereafter.

With the skew-feeding correction portion configured as described above, position correction can be performed at high speed and high accuracy while supporting a variety of sheet types. As a result, the sheets are repeatedly conveyed at high speed to the same position at the downstream side of the skew-feeding correction portion. Therefore, especially when the sheets having unprecedented large burrs and high stiffness are continuously passing for a long time, there arises a problem that the surface layer of the photosensitive drum is shaved since the sheets are conveyed to the same position of the photosensitive drum located at the downstream side of the skew-feeding correction portion.

Similarly, after passing through the photosensitive drum, the sheets are conveyed to the same position of a fixing roller of a fixing portion to fix a toner image formed on the photosensitive drum onto the sheet. Here, the surface layer of the fixing roller is formed to be soft in order to support sheets such as embossed paper as well. Therefore, as illustrated in FIG. 13, there occurs a problem that a rubber portion constituting the surface layer portion of the fixing roller 118*a* is scratched to extremely shorten the life time when the sheets S are conveyed at the same position.

Accordingly, in the related art, sheets are conveyed in the condition that the sheet correction position in the width direction of the pair of registration rollers 30 is shifted by a predetermined amount while shifting the image to be formed on the photosensitive drum by the predetermined amount, for example. With this configuration, the surface layer of the roller is prevented from being scratched caused by the sheet conveying to the same position. In this case, it is preferable that the displacement amount of the sheet correction position is to be sufficiently large in order to sufficiently prolong the life time of the roller surface layer.

With an image forming apparatus in the related art having such a skew-feeding correction portion, in the case that the sheet processing portion is arranged as described above, sheets are discharged to the sheet processing portion as being largely displaced when the sheet correction position is largely displaced. Although the sheet processing portion is capable of performing sheet correction in the width direction to some extent, the possible range for correction by the sheet processing portion is limited.

Accordingly, when the sheet correction position is largely displaced, there may be a case that sheets cannot be moved to the position where alignment by the sheet processing portion is performed before arriving at the sheet processing portion. In this case, conveyance failure such as alignment failure and jamming is apt to occur, so that the sheet processing is affected. That is, when the sheet correction position is largely shifted in order to prolong the life time of the fixing roller, there arises a problem that the sheet processing by the sheet processing portion is affected.

To address this issue, the present invention provides an image forming apparatus which can prolong life time of a fixing roller without affecting sheet processing.

SUMMARY OF THE INVENTION

According to the present invention, an image forming apparatus includes:

an image forming portion which includes a transfer portion to transfer an toner image to a sheet and a fixing portion to fix the toner image on the sheet;

a sheet re-conveying portion which conveys again a sheet having an image formed at the image forming portion to the image forming portion;

a sheet processing portion which processes a sheet to which an image is formed;

a shift portion which is arranged at the upstream side in a sheet conveying direction of the image forming portion and shifts a sheet in a width direction being perpendicular to the sheet conveying direction; and a control portion which is capable of setting a position in the width direction of a sheet passing through the fixing portion for each sheet and controls the shift portion to shift a sheet based on a setting;

wherein the control portion sets a sheet conveying position so that a side end of a sheet passing through the fixing portion passes though a first range in a case that the sheet to which an image is formed at the image forming portion is conveyed to the sheet processing portion, and the control portion sets the sheet conveying position so that the side end of a sheet passing through the fixing portion passes through both of the first range and a second range being outside of the first range or the second range in a case that the sheet to which an image is formed at the image forming portion is conveyed to the sheet re-conveying portion.

With the present invention, in the case that sheets are reversed, the sheet side end position is to be within the first range after being reversed while the sheet side end position is to be within the second range which partially overlaps with the first range before being reversed. Accordingly, life time of a fixing roller can be prolonged without affecting sheet processing.

Further features of the present invention will become apparent from the following description of exemplary embodiments (with reference to the attached drawings).

DESCRIPTION OF THE EMBODIMENTS

In the following, exemplary embodiments will be described with reference to the drawings.

Figure 1:
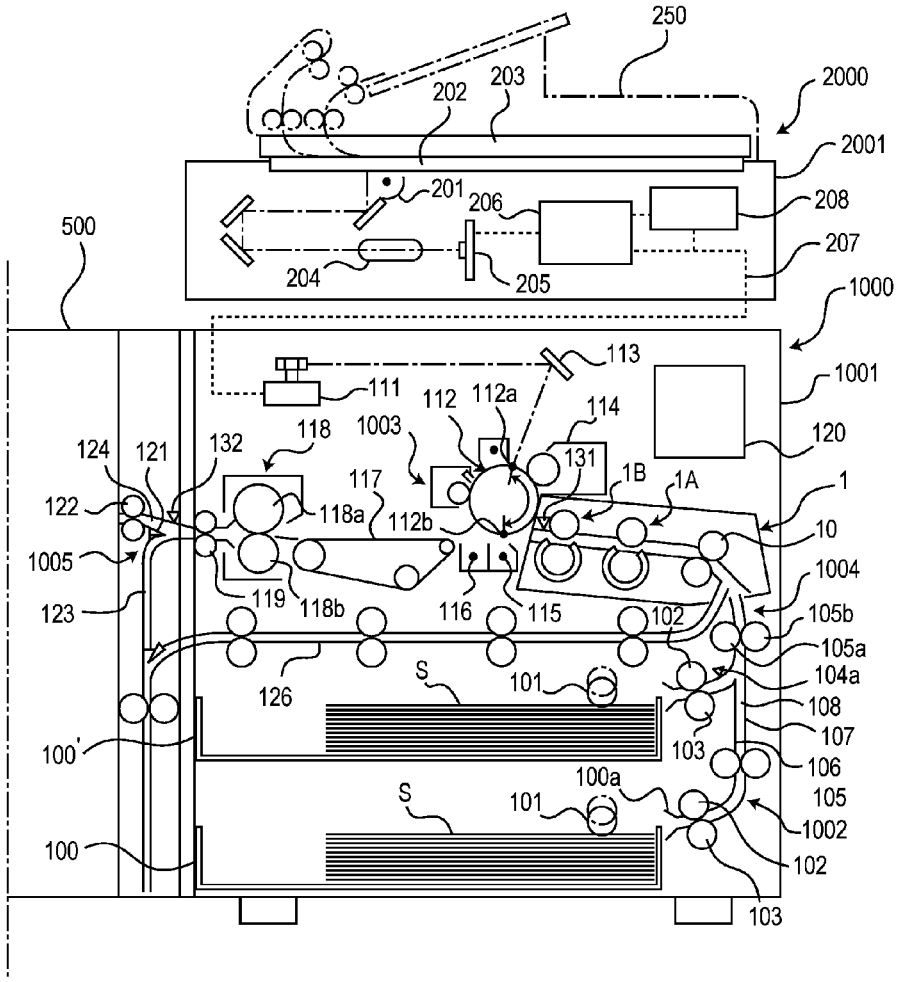
FIG. 1 is a schematic structural view of a printer as an example of an image forming apparatus according to the first embodiment of the present invention.

FIG. 1 is a schematic view of the configuration of a printer as an example of an image forming apparatus according to the first embodiment of the present invention.

As illustrated in FIG. 1, a printer 1000 includes a printer main body 1001 and a scanner 2000 which is arranged above the printer main body 1001.

The scanner 2000 to read an original is provided with a scanning optical light source 201, a platen glass 202 and an original press plate 203 which opens and closes. In addition, the scanner 2000 includes an image reading portion 2001 provided with a lens 204, a light reception element (i.e., a photoelectric conversion element) 205, an image processing portion 206, and a memory portion 208 to store image processing signals processed by the image processing portion 206.

An original is read by irradiating light with the scanning optical light source 201 onto an original (not illustrated) placed on the platen glass 202. The read original image is processed by the image processing portion 206, and then, is transmitted to a laser scanner 111 as image forming means after being converted into an electrically encoded electric signal 207. Here, it is also possible that the memory portion 208 once stores the encoded image information processed by the image processing portion 206 and that the encoded image information is transmitted to the laser scanner 111 as necessary in accordance with a signal from a controller 120.

The printer main body 1001 includes a sheet feeding apparatus 1002, a sheet conveying apparatus 1004 to convey sheets S fed by the sheet feeding apparatus 1002 to an image forming portion 1003, and the controller 120 as control means to control the printer 1000. Further, a sheet processing apparatus 500 which constitutes a sheet processing portion to perform a process such as stapling, aligning and binding against the sheets S discharged from the printer main body 1001 is arranged at one side of the printer main body 1001.

Here, the sheet feeding apparatus 1002 includes a separation portion constituted with two (i.e., a plurality of) sheet cassettes 100, 100', a pickup roller 101, a feed roller 102 and a retard roller 103. Then, the sheets S in the sheet cassettes 100, 100' are separated and fed one by one with the pickup roller 101 which is lifted-lowered and rotated at predetermined timing and action of the separation portion.

The sheet conveying apparatus 1004 constituting a sheet conveying portion is provided with a pair of vertical path rollers 105 (105*a*, 105*b*), a pair of assist rollers 10, and a skew-feeding correction portion 1 having a later-mentioned skew-feeding correction roller portion 1A and a lateral registration correction portion 113.

Then, the sheet S fed from the sheet feeding apparatus 1002 is guided, by the pair of vertical path rollers 105, to the skew-feeding correction portion 1 after passing through a sheet conveying path 108 formed of guide plates 106, 107 curved at the upper part thereof. Subsequently, the sheet S is conveyed to the image forming portion 1003 after skew feeding and the displacement in the width direction are corrected at the skew-feeding correction portion 1 as described later.

The image forming portion 1003 is of an electrophotographic system and is provided with a photosensitive drum 112 as an image bearing member, the laser scanner 111 as image writing unit, a development device 114, a transfer charger 115 and a separating charger 116.

For performing image forming, first, laser light from the laser scanner 111 is reflected by a mirror 113 and is irradiated to an exposure position 112*a* on the photosensitive drum 112 rotating in the clockwise direction, so that a latent image is formed on the photosensitive drum 112. Then, the latent image formed on the photosensitive drum 112 as described above is visualized as a toner image by the development device 114 thereafter.

Here, as illustrated in FIG. 1, a registration sensor 131 is arranged at the downstream side of the lateral registration correction portion 1B. The registration sensor 131 detects the sheet S having passed through the lateral registration correction portion 1B. When the registration sensor 131 detects the sheet S having passed through the lateral registration correction portion 1B, the controller 120 transmits a sheet top end signal (i.e., an image top signal) to the laser scanner 111 based on the detection signal, for example, after T seconds, as described later. Accordingly, the irradiation of laser light is started by the laser scanner 111.

Then, the toner image visualized on the photosensitive drum 112 as described above is transferred to the sheet S by the transfer charger 115 at a transfer portion 112*b* thereafter. Here, the distance from the laser light irradiation position 112*a* to the transfer portion 112*b* of the photosensitive drum 112 is to be a certain length shown as an arrow in the photosensitive drum 112.

Further, the sheet S having the toner image transferred is electrostatically separated from the photosensitive drum 112 by the separating charger 116, and then, conveyed by a conveying belt 117 to a fixing device 118 constituting a fixing portion. Then, the transferred image is permanently fixed when passing through a fixing nip between a fixing roller 118*a* and a pressure roller 118*b* which are arranged at the fixing device 118. Here, the surface layer of the fixing roller 118*a* is formed soft to support sheets such as embossed paper.

Consequently, the sheet S having the image fixed is discharged to the sheet processing apparatus 500 by a conveying roller 119 and a discharge roller 122 arranged at a discharge path 124. The sheets S discharged to the sheet processing apparatus 500 are subjected to a process such as stapling, and then, are discharged and piled at a sheet loading tray (not illustrated).

By the way, the printer 1000 according to the present embodiment is provided with two modes of a single mode to form an image on one side of sheets and a duplex mode to form images on both sides of sheets. A sheet re-conveying portion 1005 having a reversion path 123, a duplex path 126 and a discharge switching member 121 is provided to convey a sheet again to the image forming portion 1003 after reversing the sheet in the case of the duplex mode. In addition, a discharge sensor 132 to control switching of the discharge switching member 121 in accordance with the mode is arranged at the upstream side in the sheet conveying direction of the discharge switching member 121.

In the case of the single mode, after an image is fixed on one surface as described above, the sheet S is discharged to the sheet processing apparatus 500. On the other hand, in the case of the duplex mode, the sheet S having an image formed (i.e., fixed) on one surface thereof is conveyed to the reversion path 123 by switching the discharge switching member 121 arranged between the conveying roller 119 and the discharge roller 122.

Subsequently, the sheet S conveyed to the reversion path 123 is conveyed again to the image forming portion 1003 via the duplex path 126. Then, an image is formed on the back surface of the sheet S having no image formed. The sheet S image-formed on both surfaces is discharged to the sheet processing apparatus 500 by the discharge roller 122 thereafter.

Figure 2:
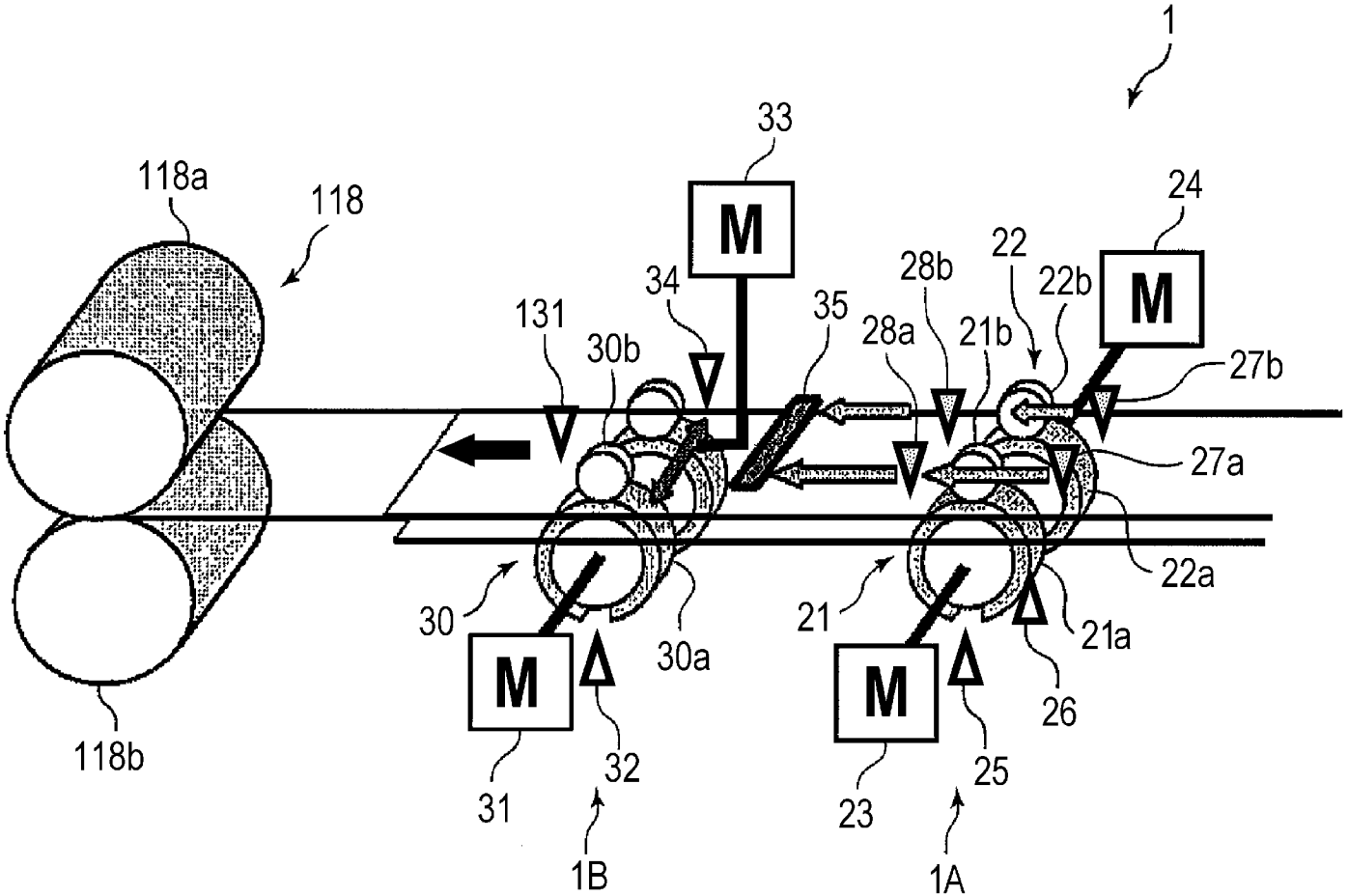
FIG. 2 is an explanatory view which illustrates the configuration of a skew-feeding correction portion arranged at the printer.

Next, the skew-feeding correction portion 1 will be described. As illustrated in FIG. 2, the skew-feeding correction portion 1 includes the skew-feeding correction roller portion 1A to correct sheet skew feeding and the lateral registration correction portion 1B to correct the displacement of sheet in the width direction. Here, the skew-feeding correction roller portion 1A includes two pairs of skew-feeding correction rollers 21, 22 arranged in the width direction having a predetermined interval.

The pairs of skew-feeding correction rollers 21, 22 are respectively constituted with a drive roller 21*a*, 22*a* as a drive rotor with a cutout portion at the circumference thereof and a driven roller 21*b*, 22*b* as a driven rotor which is press-contacted to the drive roller 21*a*, 22*a* by a pressing spring (not illustrated). Here, skew-feeding correction motors 23, 24 are connected respectively to the drive rollers 21*a*, 22*a*.

Further, activation sensors 27*a*, 27*b* are arranged respectively at the upstream side in the sheet conveying direction of the pairs of skew-feeding correction rollers 21, 22 having a predetermined interval in the width direction. Here, the activation sensors 27*a*, 27*b* detect skew-feeding amount of a sheet. The drive of the skew-feeding correction motors 23, 24 is started in accordance with the timing when the activation sensors 27*a*, 27*b* detect the sheet top end. In this manner, the sheet skew feeding can be corrected by driving the skew-feeding correction motors 23, 24 in accordance with the timing when the activation sensors 27*a*, 27*b* detect the sheet top end.

In addition, skew-feeding detection sensors 28*a*, 28*b* to detect whether or not the skew-feeding has been completely corrected by the pairs of skew-feeding correction rollers 21, 22 are arranged respectively at the downstream side in the sheet conveying direction of the pairs of skew-feeding correction rollers 21, 22 having a predetermined interval in the width direction. When skew feeding of a sheet is detected by the skew-feeding detection sensors 28*a*, 28*b*, the skew-feeding correction is performed once more by the pairs of skew-feeding correction rollers 21, 22. In the present embodiment, skew feeding of a sheet S is corrected by preceding side deceleration control to decelerate a preceding side of the sheet top end.

Meanwhile, the lateral registration correction portion 1B includes a pair of registration rollers 30 constituted with a registration drive roller 30*a* as a drive rotor with a cutout portion at the circumference thereof and a registration driven roller 30*b* as a driven rotor which is press-contacted to the registration drive roller 30*a* by a pressing spring (not illustrated). The registration drive roller 30*a* is connected to a registration motor 31.

The pair of registration rollers 30 which constitute a shift roller are arranged slidably in the width direction being perpendicular to the sheet conveying direction. The registration drive roller 30*a* (i.e., the pair of registration rollers 30) is driven in the width direction by a registration shift motor 33 being as a shift drive portion. Further, a lateral registration detection sensor 35 constituting a detection portion to detect a lateral registration position being a position in the width direction of a conveyed sheet S is arranged at the upstream side in the sheet conveying direction of the pair of registration rollers 30.

In addition, a registration sensor 131 to detect the top end of the sheet S is arranged at the downstream side of the pair of registration rollers 30. As illustrated in FIG. 2, skew-feeding correction home position (HP) sensors 25, 26 are provided to respectively detect home positions of the pairs of skew-feeding correction rollers 21, 22.

Figure 5:
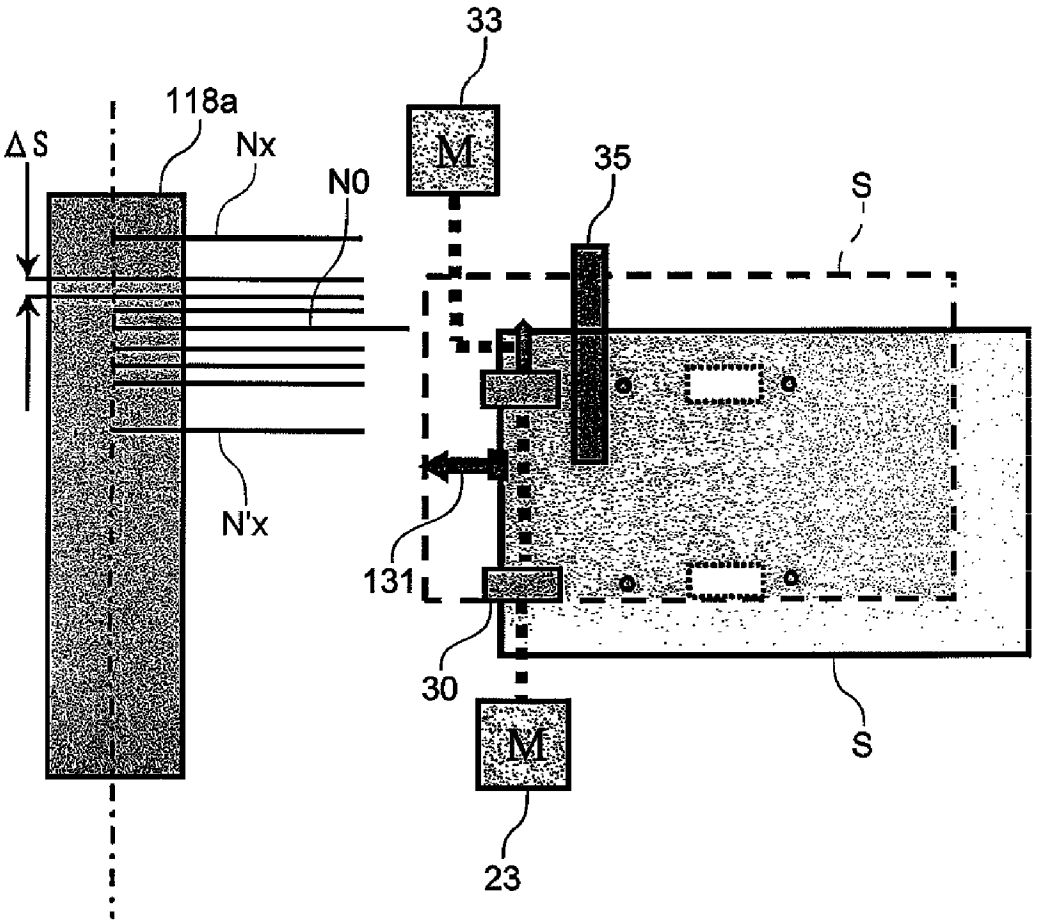
FIG. 5 is a view which illustrates the control operation of skew-feeding correction and registration correction by the skew-feeding correction portion.

In the present embodiment, the shifting of a sheet in the width direction is performed so that the shifted sheet passes through a predetermined position among predetermined shift positions (Nx~N'x, Ny~N'y) of the fixing roller 118*a* as illustrated in FIGS. 5 and 6, as described later. Accordingly, the life time of the fixing roller 118*a* can be prolonged. Here, in order to enable such sheet shifting, the exposure position on the photosensitive drum is shifted and the sheet is previously shifted in the width direction.

As described above, the printer 1000 has a single mode and a duplex mode. The shift positions (hereinafter called the reciprocation positions) Nx~N'x are set within a range so as not to cause conveyance failure such as alignment failure and jamming at the sheet processing apparatus 500 when the sheet S is discharged in either of the single mode and the duplex mode. Meanwhile, the reciprocation positions Ny~N'y are set within a range so as to shift a sheet having an image formed (i.e., fixed) on the front surface (i.e., the first surface) when the duplex mode is set.

Figure 6A:
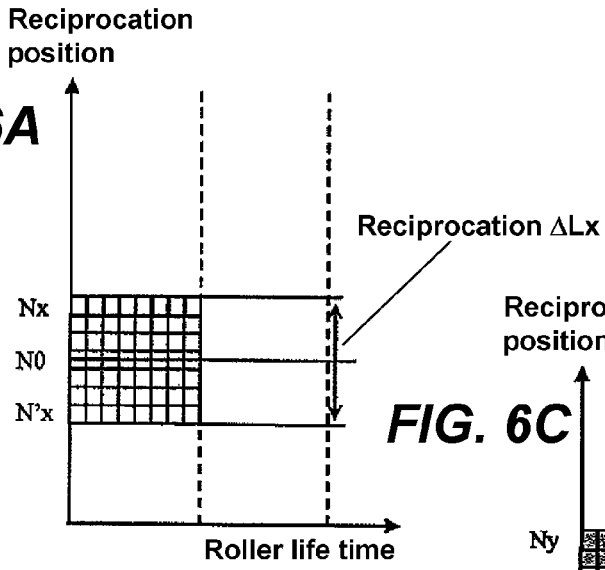
FIG. 6 is a view which illustrates the relation between sheet-passing count (i.e., life time of a fixing roller) and reciprocation positions of the printer.
Figure 6B:
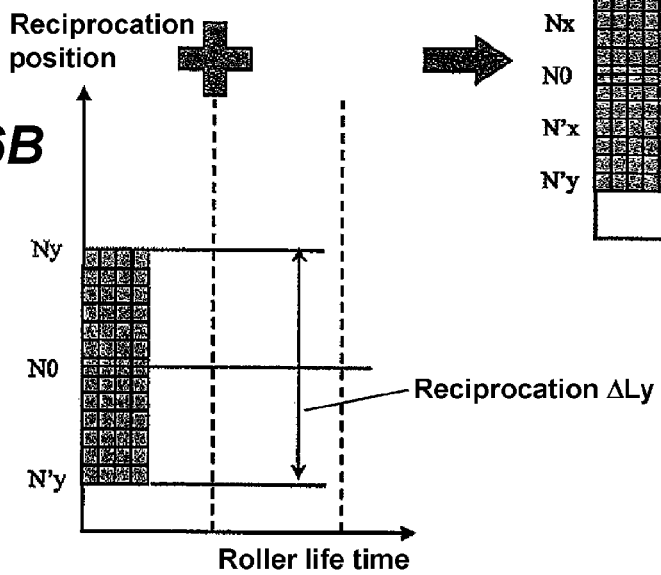

In the case that the duplex mode is set, after an image is formed on the front surface, the sheet S is conveyed to the reversion path 123 and the duplex path 126 without being discharged to the sheet processing apparatus 500. Therefore, it is not necessary to evaluate the occurrence of alignment failure and the like at the sheet processing apparatus 500. Accordingly, the distance ΔLx between the most distanced reciprocation positions among the first reciprocation positions Nx~N'x as illustrated in FIG. 6A is set to be shorter than the distance ΔLy between the most distanced reciprocation positions among the second reciprocation positions Ny~N'y as illustrated in FIG. 6B. With this configuration, the second reciprocation positions Ny~N'y partially overlap with the first reciprocation positions Nx~N'x.

As described above, in the present embodiment, the first reciprocation positions Nx~N'x are to be set so as not to cause conveyance failure such as alignment failure and jamming at the sheet processing apparatus 500 for discharging a sheet. Meanwhile, in the case that the sheet which is reversed by the sheet re-conveying portion 1005 and to be conveyed to the image forming portion 1003 again is shifted after selecting the duplex mode and forming an image on the front surface, the second reciprocation positions Ny~N'y being wider than the first reciprocation positions Nx~N'x are to be set.

In this manner, by shifting the sheet having an image formed on the front surface at the second reciprocation positions Ny~N'y being wider than the first reciprocation positions Nx~N'x when the duplex mode is set, the life time of the fixing roller 118*a* can be prolonged.

Figure 3:
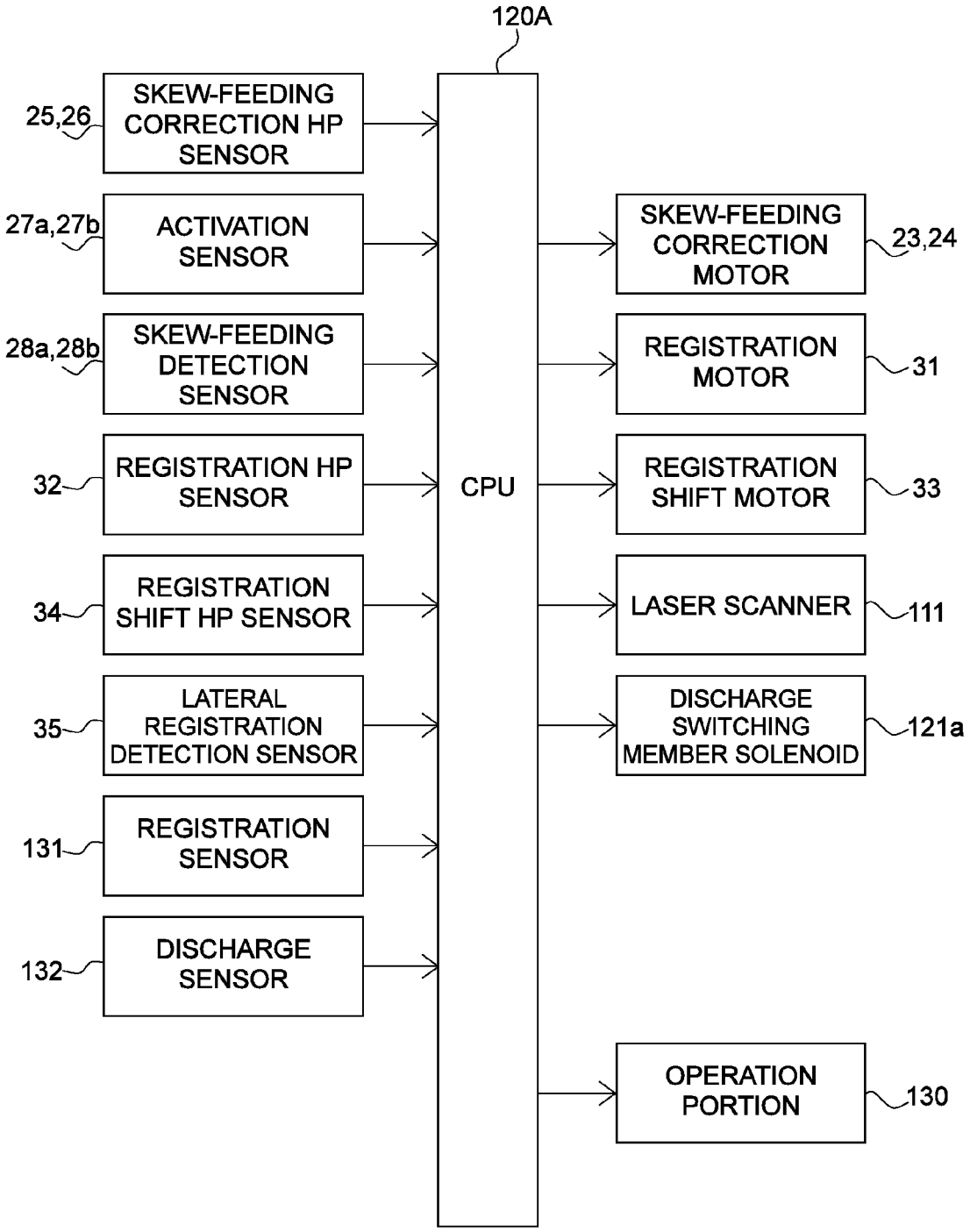
FIG. 3 is a control block diagram of the printer.

FIG. 3 is a control block diagram of the printer 1000. The detection signals from the abovementioned skew-feeding correction HP sensors 25, 26 and the abovementioned activation sensors 27*a*, 27*b* are input to a CPU 120A arranged at the controller 120 (see FIG. 1). In addition, the detection signals from the skew-feeding detection sensors 28*a*, 28*b*, the registration HP sensor 32, the registration shift HP sensor 34, the lateral registration detection sensor 35 and the discharge sensor 132 are input to the CPU 120A being as a control portion.

Meanwhile, the CPU 120A is connected with the skew-feeding correction motors 23, 24, the registration motor 31, the registration shift motor 33, the laser scanner 111, a discharge switching member solenoid 121*a* to move the discharge switching member 121, and an operation portion 130. The CPU 120A drives the motors based on the detection signals from the sensors and a start signal of copying or printing from the operation portion 130.

Figure 4:
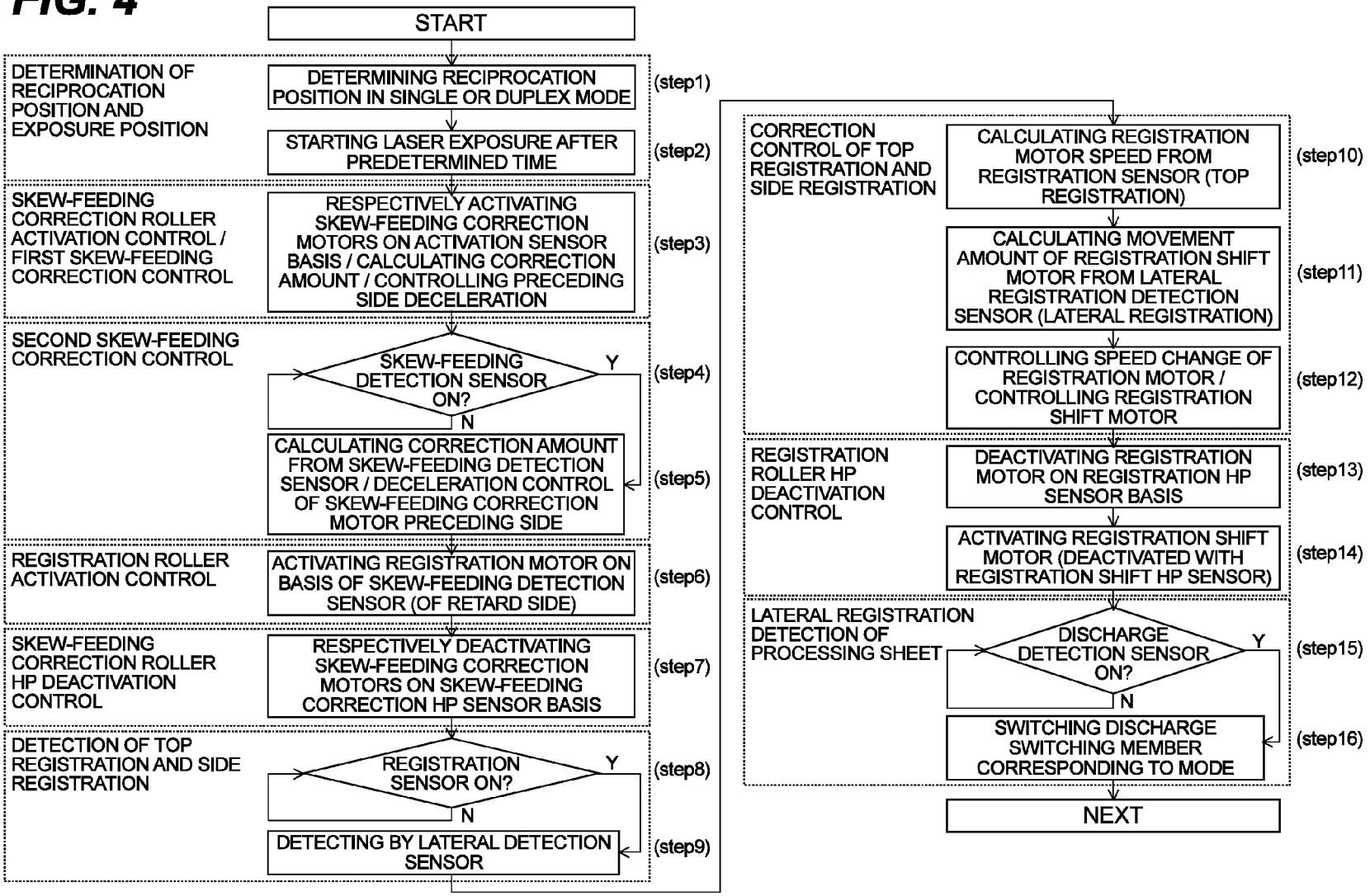
FIG. 4 is a flowchart which describes control operation of skew-feeding correction and registration correction by the skew-feeding correction portion.

Control operation of skew-feeding correction and registration correction as described in a flowchart of FIG. 4 is performed by the CPU 120A (i.e., by the controller 120).

When copying or printing is started, the reciprocation position is determined in accordance with the single mode or duplex mode set by the operation portion 130 (Step 1). After a predetermined time, laser exposure is started in accordance with the determined reciprocation position (Step 2).

Next, when the activation sensors 27*a*, 27*b* detect the top end of the sheet S conveyed to the skew-feeding correction portion 1 after the determination process of the reciprocation position and exposure position, the skew-feeding correction motors 23, 24 are activated with reference to the detection timing of respective activation sensors 27*a*, 27*b*. The skew-feeding amount of the sheet top end and the correction amount are calculated from the detection time difference between the activation sensors 27*a*, 27*b*. Based on the calculated correction amount, the first skew-feeding correction is performed with the abovementioned preceding side deceleration control by rotating the pairs of skew-feeding correction rollers 21, 22 having respective roller nip portions released (Step 3).

Then, after the processes of the skew-feeding correction roller activation control and the first skew-feeding correction control, the skew-feeding detection sensors 28*a*, 28*b* are expected to be ON (Step 4). When the skew-feeding detection sensors 28*a*, 28*b* become ON ("Y" in Step 4), the correction amount is calculated by calculating the skew-feeding amount of the sheet top end with reference to the respective detection timing. Subsequently, based on the calculated correction amount, the second skew-feeding correction is performed with the abovementioned preceding side deceleration control by driving the skew-feeding correction motors 23, 24 to rotate the pairs of skew-feeding correction rollers 21, 22 (Step 5).

After the second skew-feeding correction control, the registration motor 31 is activated on a basis of the skew-feeding detection sensor (of the retard side) (Step 6: i.e., the registration roller activation control). Accordingly, the sheet S is conveyed by rotating the pair of registration rollers 30 of which roller nip portion is released. When the sheet S is nipped by the pair of registration rollers 30 thereafter, the skew-feeding correction motors 23, 24 are respectively deactivated on a skew-feeding correction HP sensor basis in the state that the roller nip portions of the pairs of skew-feeding rollers 21, 22 are released (Step 7: i.e., the skew-feeding roller HP deactivation control).

Then, the registration sensor 131 is expected to be ON by detecting the sheet S (Step 8). When the registration sensor 131 detects the sheet S and becomes ON ("Y" in Step 8), a side end position of the sheet S is detected by the lateral registration detection sensor 35 (Step 9). After the detection process of the top registration and side registration, speed calculation of the registration motor 31 is performed from the signal of the registration sensor 131 (Step 10). Further, the registration shift motor 33 is activated in accordance with the lateral registration amount detected by the lateral registration detection sensor 35 (i.e., the sheet side end position information).

In the present embodiment, subsequently, the difference between the detection signal of the lateral registration sensor 35 and the center position NO among the reciprocation positions Nx~N'x previously set according to sheet size information is calculated and the movement amount by the registration shift motor 33 is calculated, as illustrated in FIG. 5. Further, the lateral registration displacement amount of the sheet cassette 100 is calculated from the difference (Step 11). In the present embodiment, the sheet conveying of the printer 1000 is performed on a center-basis. Accordingly, the lateral registration displacement amount is the amount in the case that the center in the sheet conveying direction is taken as a basis.

Next, speed change control of the registration motor 31 is performed based on the time difference between the detection timing of the registration sensor 131 and the radiation timing of laser light onto the photosensitive drum 112, so that the image position on the photosensitive drum 112 and the top end position of the sheet S are aligned. In addition, the registration shift motor 33 is controlled based on the detection signal of the lateral registration sensor 35 and the determined reciprocation position, so that the image position on the photosensitive drum 112 and the lateral registration position of the sheet S are aligned (Step 12).

When the sheet S is conveyed to the transfer portion by the pair of registration rollers 30 after the correction control of the top registration and side registration, the registration motor 31 is deactivated in the state that the roller nip portion of the pair of registration rollers 30 are released on the registration HP sensor 32 basis (Step 13). Simultaneously, the registration shift motor 33 is activated to perform shift-movement in the direction opposite to the correction direction, and then, the registration shift motor 33 is deactivated when the registration shift HP sensor 34 becomes OFF (Step 14).

Next, the sheet S accurately position-corrected to the image on the photosensitive drum 112 is conveyed to the fixing device 118. Subsequently, in the case of the duplex mode, it is determined whether or not the discharge sensor 132 is ON (Step 15). When the discharge sensor 132 becomes ON ("Y" in Step 15), the discharge switching member 121 is switched by operating the discharge switching member solenoid 121*a* based thereon, so that the sheet S is conveyed to the reversion path 123 (Step 16). Meanwhile, in the case of the single mode, the sheet S is discharged to the sheet processing apparatus 500 by the conveying roller 119 and the discharge roller 122.

Here, in the case that the sheet S is discharged to the sheet processing apparatus 500, the sheet S is arranged by the pair of registration rollers 30 so that the sheet side end position passes through a predetermined position among the first reciprocation positions Nx~N'x being set as illustrated in FIGS. 5 and 6A. In the case that the sheet S is conveyed to the reversion path 123 and the duplex path 126, the sheet S is arranged so that the sheet side end position passes through a predetermined position among the second reciprocation positions Ny~N'y being set as illustrated in FIG. 6B.

Consequently, in the present embodiment, the sheet is moved so that the sheet side end positions are to be within a predetermined range in the width direction in accordance with the set mode. For example, in the case of the single mode to discharge the image-formed sheet S to the sheet processing apparatus 500, the sheet S is arranged to pass through the first reciprocation positions Nx~N'x defining the first range in the width direction.

Meanwhile, in the case of the duplex mode to discharge the sheet S to the sheet processing apparatus 500 after being reversed, the sheet S is arranged to pass through the second reciprocation positions Ny~N'y defining the second range in the width direction before being reversed.

Figure 6C:
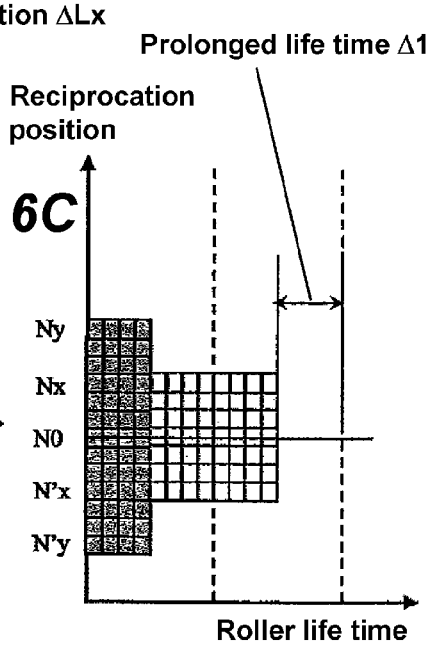

In FIGS. 6A to 6C, the horizontal axis indicates sheet-passing count for each position of the reciprocation positions (i.e., the fixing roller life time) and the vertical axis indicates reciprocation positions. FIG. 6A illustrates sheet-passing count of the sheets S conveyed to the discharge path 124 for each reciprocation position of the first reciprocation positions Nx~N'x. Further, FIG. 6B illustrates sheet-passing count of the sheets S conveyed to the duplex path 126 for each reciprocation position of the second reciprocation positions Ny~N'y.

Furthermore, FIG. 6C illustrates the sum of sheet-passing count of the sheets S conveyed to the discharge path 124 for each reciprocation position of the first reciprocation positions Nx~N'x and sheet-passing count of the sheets S conveyed to the duplex path 126 for each reciprocation position of the second reciprocation positions Ny~N'y.

Here, the maximum distance ΔLx between the most distanced reciprocation positions among the first reciprocation positions Nx~N'x through which the conveyed sheet passes is set to be shorter than the maximum distance ΔLy between the most distanced reciprocation positions among the second reciprocation positions Ny~N'y of conveying to the duplex path 126. That is, the range of the first reciprocation positions Nx~N'x where the conveyed sheet is moved in the width direction (i.e., the movement range in width direction) is narrower than the range of the second reciprocation positions Ny~N'y through which the sheet conveyed to the duplex path 126 passes.

In the case that the sheet movement range in the width direction of the duplex mode to reverse a sheet with the sheet re-conveying portion 1005 is configured to be different from that of the single mode, the fixing roller life time is to be prolonged by ΔT1 as illustrated in FIG. 6C. That is, the fixing roller life time can be prolonged by ΔT1 simply by arranging the maximum distance of the reciprocation positions to be ΔLy which is longer than ΔLx only when a sheet is conveyed to the duplex path 126 in the duplex mode.

For example, in the duplex mode, when the maximum distance ΔLy of the reciprocation positions in the case that the sheet is conveyed to the duplex path 126 is set to be two times of ΔLx, the fixing roller life time can be prolonged by approximate 33% compared to the case of the maximum distance ΔLx of the reciprocation positions. Here, in the present embodiment, the maximum distances ΔLx, ΔLy and the distance (i.e., the interval) between two reciprocation positions ΔS can be arbitrarily adjusted by repair people and the like.

In this manner, by arranging the maximum distance of the reciprocation positions of sheet movement in the width direction to be different between the case of reversing a sheet and the case of discharging a sheet without reversing, the life time of the fixing roller 118*a* can be prolonged without affecting the sheet processing. In other words, in the case of sheet reversing, by arranging the side end position of the sheet to be within the second reciprocation positions before being reversed and to be within the first reciprocation positions after being reversed, the life time of the fixing roller 118*a* can be prolonged without affecting the sheet processing.

In the above description, the skew-feeding correction portion of the so-called active registration type is taken as an example. However, for example, the present invention can also be adopted to a skew-feeding correction portion of a so-called skew-feeding registration type to correct skew feeding while a skewed sheet is hit to a hit plate by a pair of skew-feeding rollers.

Next, the second embodiment of the present invention having a skew-feeding correction portion of such a skew-feeding registration type will be described.

Figure 7:
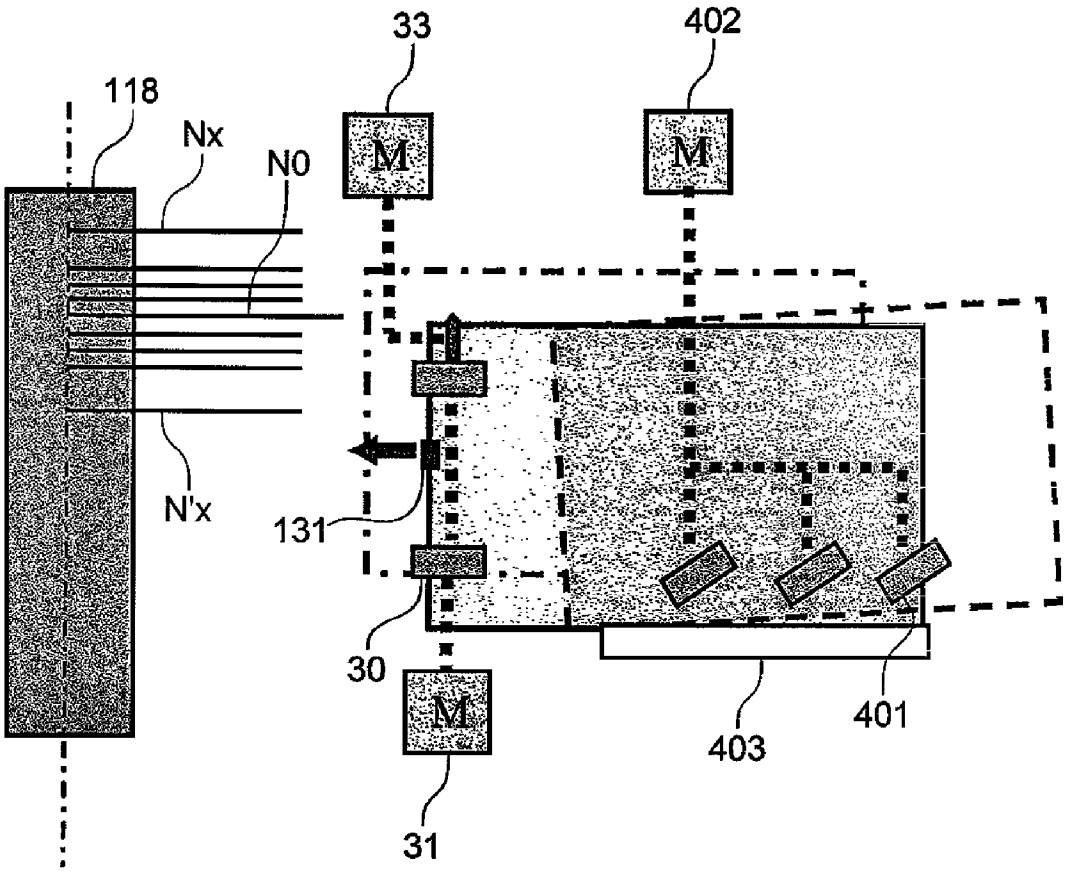
FIG. 7 is a view which illustrates the configuration of a skew-feeding correction portion of a skew-feeding registration type arranged at an image forming apparatus according to the second embodiment of the present invention.

FIG. 7 is a view which illustrates the configuration of the skew-feeding correction portion of the skew-feeding registration type adopted to an image forming apparatus according to the present embodiment.

A pair of skew-feeding rollers 401 to skew-feed a sheet S and a hit plate 403 as a regulating member to regulate a sheet side end position by contacting to the sheet S skew-fed by the pair of skew-feeding rollers 401 are illustrated in FIG. 7. At such a skew-feeding correction portion, sheet skew feeding is corrected while the skew-fed sheet S is hit to the hit plate 403 by the pair of skew-feeding rollers 401 driven by a skew-feeding motor 402.

Then, similar effects can be obtained by shifting the sheet S toward the far side against the conveying direction with the pair of registration rollers 30 after the sheet top end shifted toward the near side against the conveying direction by the skew-feeding registration is detected by the registration sensor 131.

Figures 8A, 8B, 8C:
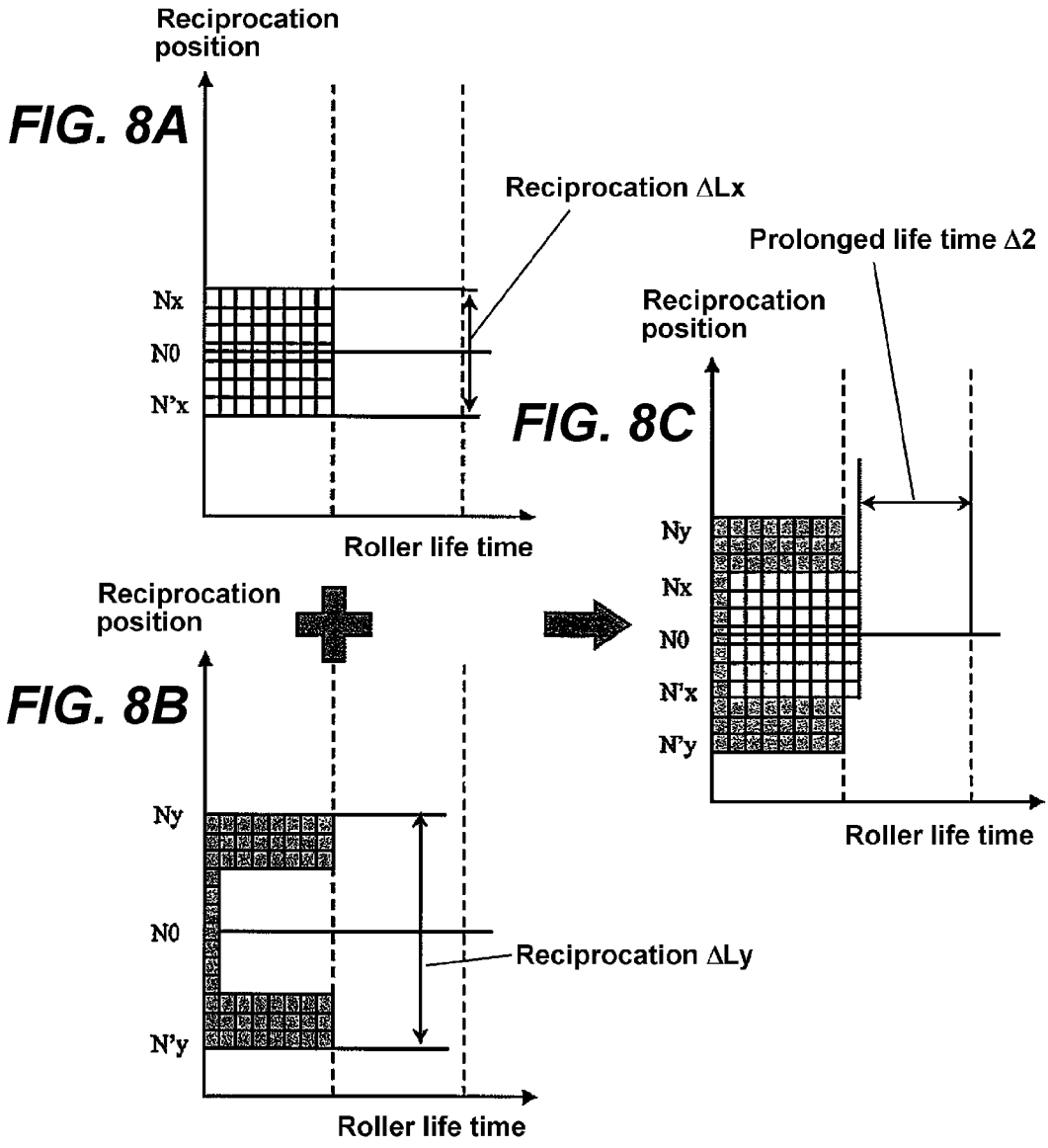
FIG. 8 is a view which illustrates the relation between sheet-passing count (i.e., life time of the fixing roller) and reciprocation positions of the image forming apparatus.

In FIGS. 8A to 8C, the horizontal axis indicates sheet-passing count for each position of the reciprocation positions (i.e., the fixing roller life time) and the vertical axis indicates reciprocation positions. FIG. 8A illustrates sheet-passing count of the sheets S conveyed to the discharge path 124 for each reciprocation position. FIG. 8B illustrates sheet-passing count of the sheets S conveyed to the duplex path 126 for each reciprocation position. FIG. 8C illustrates the sum of sheet-passing count of the sheets S conveyed to the discharge path 124 for each reciprocation position and sheet-passing count of the sheets S conveyed to the duplex path 126 for each reciprocation position.

In the present embodiment, as illustrated in FIG. 8C, the fixing roller life time can be prolonged by ΔT2 simply by arranging the maximum distance of the reciprocation positions to be ΔLy which is longer than ΔLx only when a sheet is conveyed to the duplex path 126 in the duplex mode.

For example, in the duplex mode, when the maximum distance ΔLy in the case that the sheet is conveyed to the duplex path 126 is set to be two times of ΔLx, the fixing roller lifetime can be prolonged approximately to be doubled compared to the case of the maximum distance ΔLx of the reciprocation positions.

As described above, in the present embodiment as well, the fixing roller life time can be prolonged by varying the reciprocation amount in accordance with the sheet path for sheet-passing even with the fixing roller 118*a* having a soft surface to support every medium.

In the above description, the maximum distance ΔLx of the reciprocation positions of discharging to the discharge path 124 is to be smaller than the maximum distance ΔLy of the reciprocation positions of conveying to the duplex path 126. However, the present invention is not limited to this configuration. For example, in the case that an allowable range of the sheet processing apparatus side is large to some extent, it is also possible, in the duplex mode, to shorten the maximum distance of the reciprocation positions only when a sheet is conveyed to the duplex path 126 and to lengthen the maximum distance of the reciprocation positions when a sheet is conveyed to the discharge path 124. Further, in the above description, the reciprocation positions of discharging to the discharge path 124 and the reciprocation positions of conveying to the duplex path 126 are controlled to be overlapped at some part. However, the present invention is not limited to this configuration. The reciprocation positions of discharging to the discharge path 124 and the reciprocation positions of conveying to the duplex path 126 may be set to be separate ranges so as not to overlap.

Figure 9:
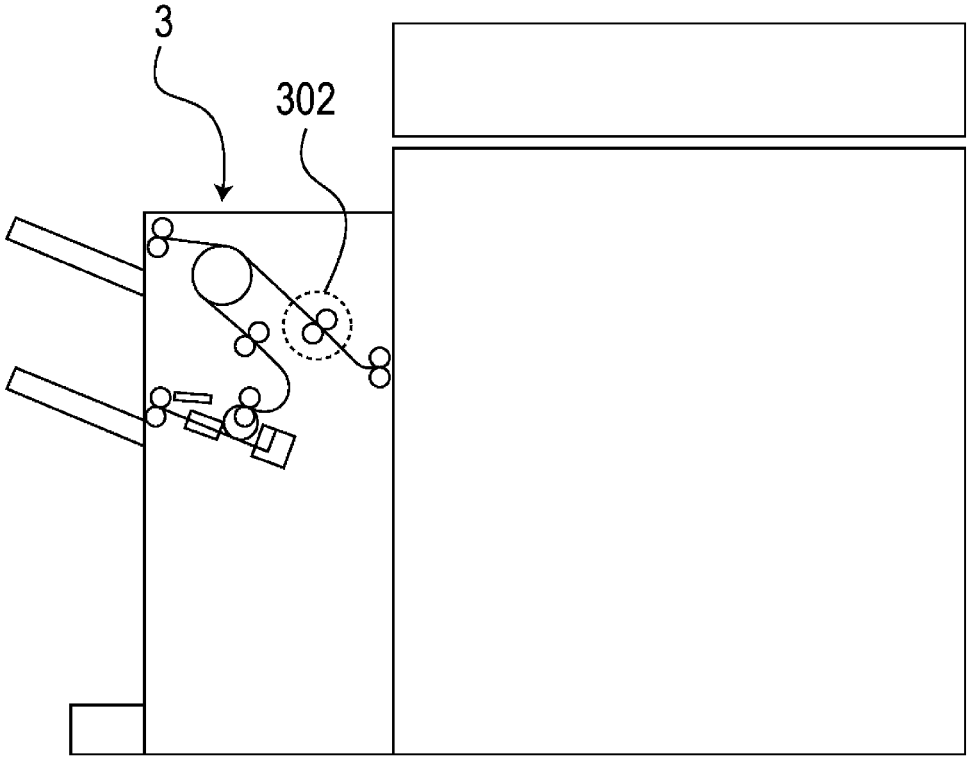
FIG. 9 is a sectional view of an image forming apparatus according to another embodiment of the present invention.
Figure 10:
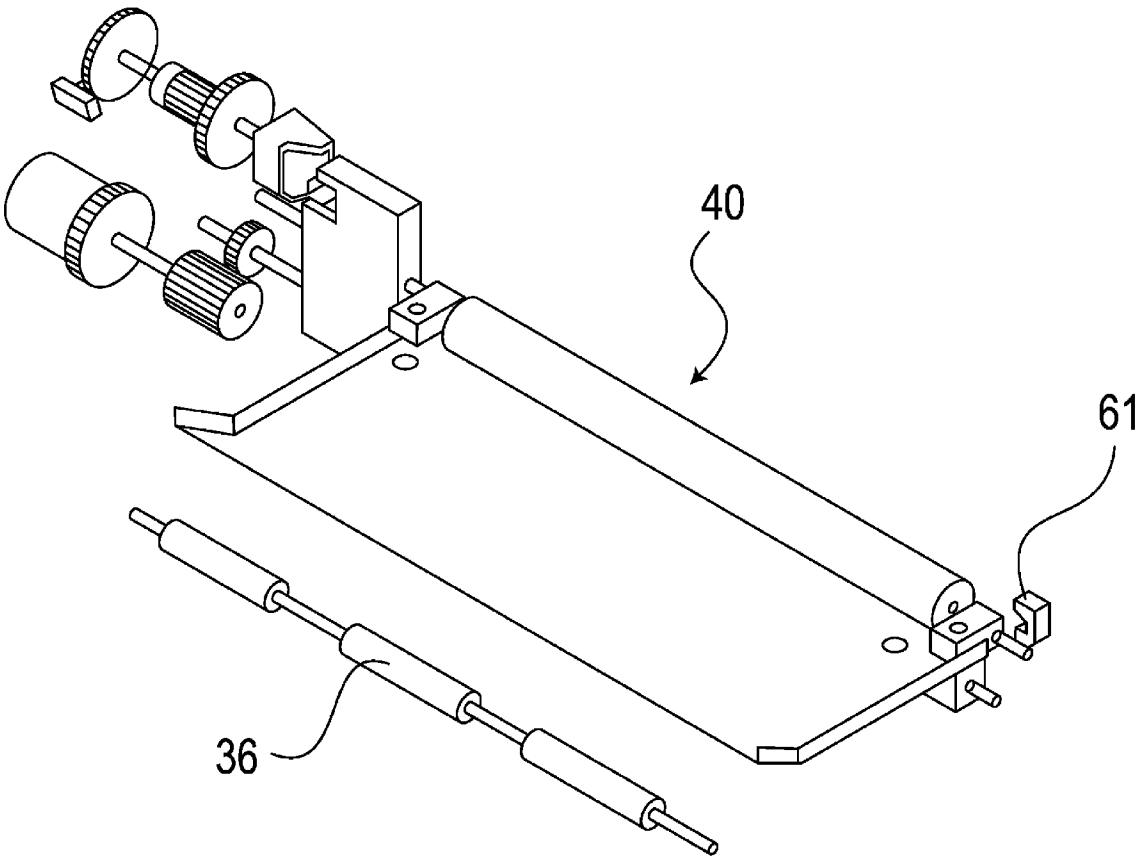
FIG. 10 PRIOR ART
FIG. 10 is a view which illustrates the configuration of a registration device in the related art.
Figure 11:
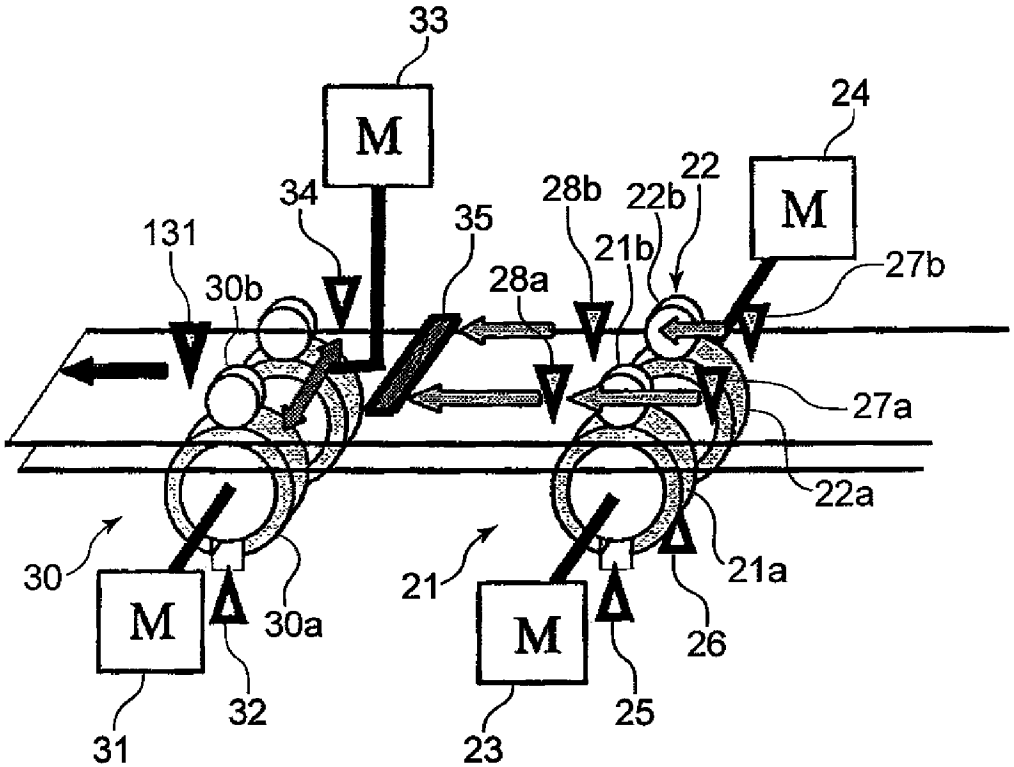
FIG. 11 PRIOR ART
FIG. 11 is a view which illustrates the configuration of a skew-feeding correction portion of an active skew-feeding correction type in the related art.
Figure 12A:
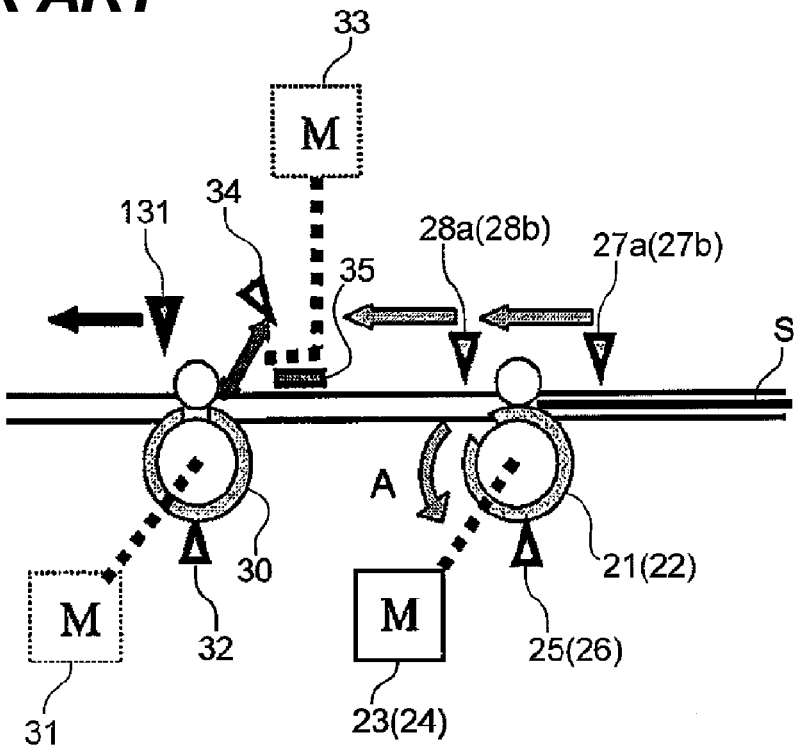
FIG. 12A PRIOR ART
FIGS. 12A and 12B are explanatory views which illustrate operation of the skew-feeding correction portion of the active skew-feeding correction type in the related art.
Figure 12B:
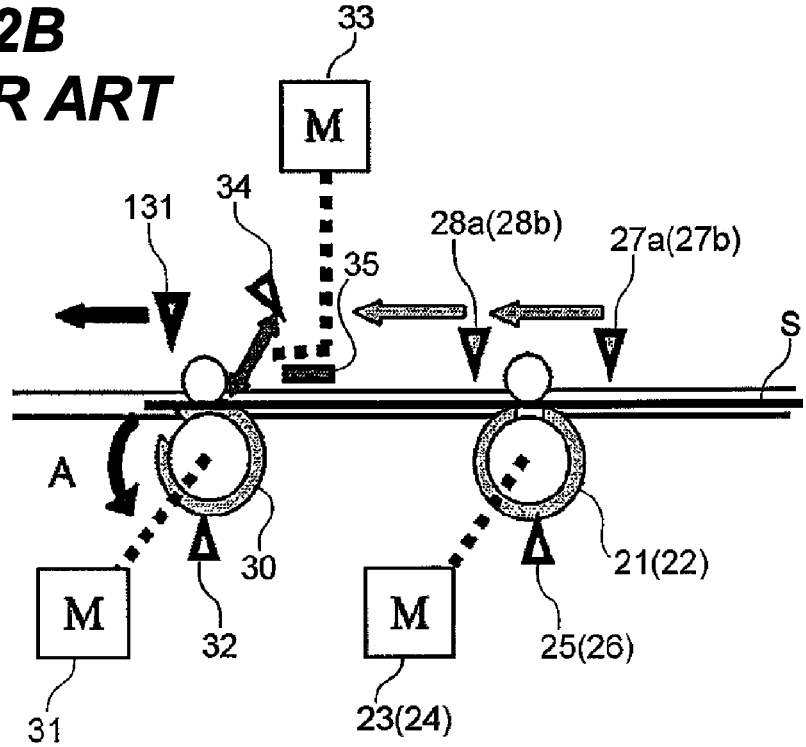
FIG. 12B PRIOR ART
Figure 13:
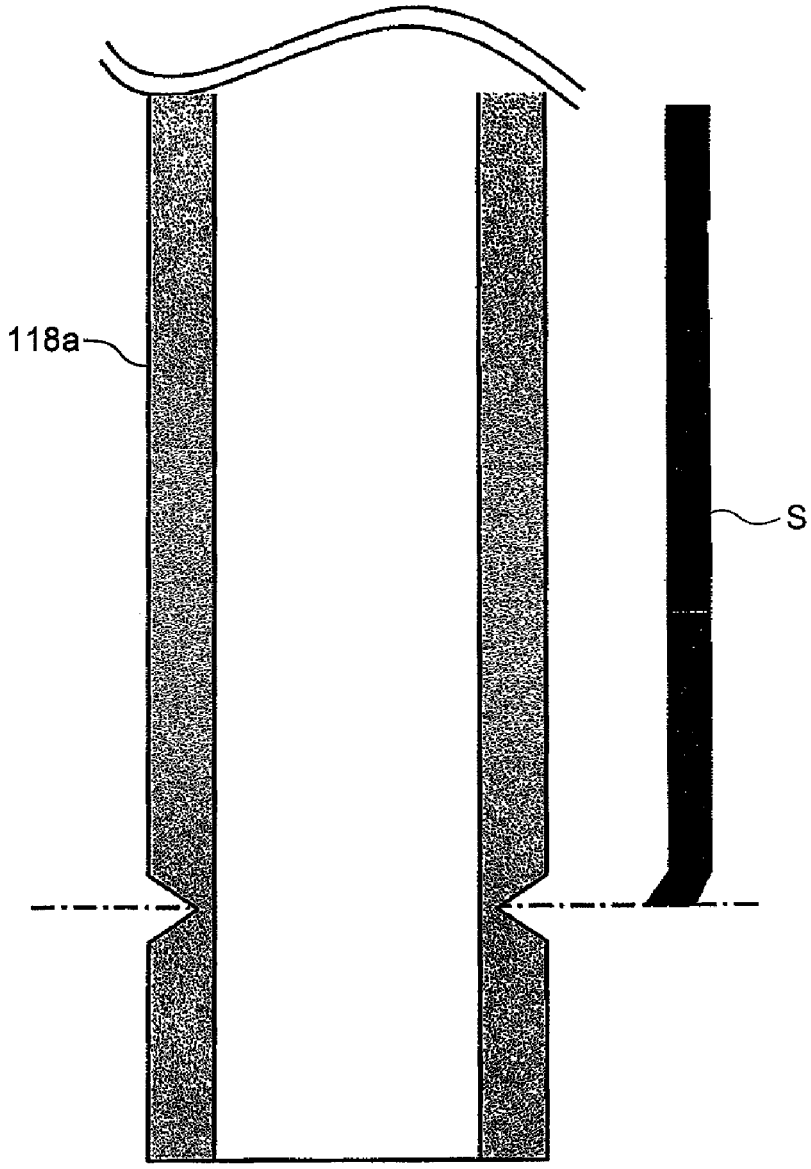
FIG. 13 PRIOR ART
FIG. 13 is a view which illustrates a scratch at the fixing roller of the image forming apparatus in the related art generated by a sheet.

The above case will be described taking the configuration provided with a sheet processing apparatus 3 for a discharge application as an example as illustrated in FIG. 9.

Some sheet processing apparatus 3 is provided with a shift roller 302 and a lateral registration detection sensor (not illustrated), and is capable of shift-moving a sheet S to a predetermined position by detecting a lateral position of the sheet S being similar to the pair of registration rollers 30 and the lateral registration sensor 35. With the skew-feeding registration type illustrated in FIG. 7, the reciprocation movement amount to the duplicate side is to be restricted by the angle of the pair of skew-feeding rollers 401 and the position of the hit plate 403.

Accordingly, in the configuration of combination of the skew-feeding type of FIG. 7 and the discharge application of FIG. 9, the allowable range at the registration portion is to be small and the allowable range of the discharge application side is to be large. In such a case, the fixing roller life time can be further prolonged as well by further enlarging the maximum distance ΔLx of the reciprocation positions of discharging to the discharge path 124 than the maximum distance ΔLy of the reciprocation positions of conveying to the duplex path 126.

In the above, the configuration with the discharge path 124 and the duplex path 126 is described. However, it is similar to an application connected to the downstream side. That is, life time affected by scratches at the surface layer of the fixing roller can be sufficiently obtained without causing conveyance failure such as alignment failure and jamming at a downstream conveyance process by changing the maximum distance ΔL of the reciprocation positions in accordance with the configuration of an application to be connected.

Further, in the above description, the maximum distance of the reciprocation positions are changed when a sheet is conveyed to either the duplex path 126 or the discharge path 124. However, in the case that another path is provided, it is also possible to change the maximum distance ΔL of the reciprocation positions in accordance with the path. Furthermore, in the above description, the sheet processing apparatus 500 is arranged beside the printer main body 1001. However, the present invention can be adopted to the configuration that the sheet processing apparatus 500 is arranged inside the printer main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-018815, filed Jan. 29, 2009, which is hereby incorporated by reference herein in its entirety.

What is claimed is:

1. An image forming apparatus comprising:

an image forming portion which includes a transfer portion to transfer a toner image to a sheet and a fixing portion to fix the toner image on the sheet;

a sheet re-conveying portion which re-conveys the sheet having an image formed at the image forming portion to the image forming portion;

a sheet processing portion which processes the sheet having the image formed by the image forming portion;

wherein the sheet processing portion can accept and convey sheets at a first plurality of sheet conveying positions, where the first plurality of sheet conveying positions each have a sheet side edge located in a first range;

a shift portion which is arranged upstream of the image forming portion in a sheet conveying direction and shifts the sheet in a width direction being perpendicular to the sheet conveying direction;

wherein the shift portion can shift the sheet to a second plurality of sheet conveying positions each having the sheet side edge located in the first range or a second range, wherein the second range is outside of the first range; and a control portion which selectively sets a sheet conveying position of each sheet in the width direction of the sheet passing through the fixing portion for each sheet and controls the shift portion to shift the sheet based on whether a duplex mode, where the sheet re-conveying portion re-conveys the sheet, is set or a single mode, where the sheet is not re-conveyed, is set;

wherein when the duplex mode is set, the control portion selects the sheet conveying position of the sheet, when forming the image on a front surface of the sheet, so that the side edge of the sheet passes through the fixing portion through either the first range or the second range, and the control portion selects the sheet conveying position of the sheet, when forming the image on a back surface of the sheet, so that the side edge of the sheet passes through the fixing portion through the first range.

2. The image forming apparatus according to claim 1, wherein the first range is a range of sheet positions where the sheet side edge location of the sheet can be corrected by the sheet processing portion when the sheet processing portion processes the sheet.

3. The image forming apparatus according to claim 1, wherein the first range is narrower than the second range.

4. The image forming apparatus according to claim 1, further comprising a detection portion which detects a side end position in the width direction of the sheet conveyed to the image forming apparatus, wherein when the sheet is conveyed in a manner of a center basis, the detection portion detects a side end position in a conveyance direction so as to set the center basis to a center of the sheet in the conveyance direction.

5. The image forming apparatus according to claim 1, further comprising:

a correction portion which is arranged at the upstream side of the image forming portion and corrects skew feeding of the sheet; and a detection portion which detects a side end position in the width direction of the sheet corrected at the correction portion;

the correction portion comprising a skew-feeding correction roller to correct skew feeding of the sheet, a shift roller to shift in the width direction of the sheet of which skew feeding is corrected by the skew-feeding correction roller, and a shift drive portion to shift the shift roller;

wherein the control portion controls the shift drive portion so as to shift the shift roller in the width direction based on the sheet side end position information from the detection portion.

6. The image forming apparatus according to claim 1, further comprising:

a correction portion which is arranged at the upstream side of the image forming portion and corrects skew feeding of the sheet; and a detection portion which detects a side end position in the width direction of a sheet corrected at the correction portion;

the correction portion comprising a skew-feeding roller to skew-feed the sheet, a restriction member to restrict a side end position of the sheet by contacting to the sheet skew-fed by the skew-feeding roller, a shift roller to shift in the width direction of the sheet of which side end position is restricted by the restriction member, and a shift drive portion to shift the shift roller;

wherein the control portion controls the shift drive portion so as to shift the shift roller in the width direction based on the sheet side end position information from the detection portion.

7. The image forming apparatus according to claim 1, wherein when the single mode is set, the control portion selects the sheet conveying position of the sheet so that the side edge of the sheet passes through the fixing portion in the first range.

* * * * *